United States Patent [19]

Deviny

[11] Patent Number: 4,975,300

[45] Date of Patent: Dec. 4, 1990

[54] METHOD FOR CURING AN ORGANIC COATING USING CONDENSATION HEATING AND RADIATION ENERGY

[75] Inventor: Edward J. Deviny, Roseville, Minn.

[73] Assignee: Minnesota Mining and Manufacturing Company, St. Paul, Minn.

[21] Appl. No.: 251,678

[22] Filed: Sep. 30, 1988

Related U.S. Application Data

[62] Division of Ser. No. 140,024, Dec. 31, 1987.

[51] Int. Cl.[5] ..... B05D 3/06

[52] U.S. Cl. ..... 427/54.1; 427/55; 427/335; 427/377; 427/385.5; 427/386

[58] Field of Search ..... 427/55, 54.1, 384, 385.5, 427/389, 377, 335; 118/48, 423, 642, 61

[56] References Cited

U.S. PATENT DOCUMENTS

| | | | |
|---|---|---|---|
| 3,117,099 | 1/1964 | Proops et al. | 260/18 |
| 3,595,205 | 7/1971 | Surprenant | 118/61 |
| 3,866,307 | 2/1975 | Pfahl et al. | 29/498 |
| 3,981,897 | 9/1976 | Crivello | 260/440 |
| 4,000,115 | 2/1976 | Jacobs | 260/47 |
| 4,026,705 | 5/1977 | Crivello et al. | 96/115 |
| 4,058,401 | 11/1977 | Crivello | 96/115 |
| 4,069,054 | 1/1978 | Smith | 96/115 |
| 4,073,967 | 2/1978 | Sandvig | 427/44 |
| 4,101,513 | 7/1978 | Fox et al. | 526/193 |
| 4,161,478 | 7/1979 | Crivello | 260/327 |
| 4,173,476 | 11/1979 | Smith et al. | 430/280 |
| 4,246,298 | 1/1981 | Guarnery et al. | 427/46 |
| 4,249,011 | 2/1981 | Wendling | 548/312 |
| 4,256,512 | 3/1981 | Ammann et al. | 134/64 |
| 4,288,527 | 9/1981 | Morgan | 430/288 |
| 4,318,766 | 3/1982 | Smith | 156/330 |
| 4,329,478 | 5/1982 | Behr | 549/11 |
| 4,394,403 | 7/1983 | Smith | 427/42 |
| 4,428,807 | 1/1984 | Lee et al. | 204/159 |
| 4,444,806 | 4/1984 | Morgan et al. | 427/45.1 |
| 4,517,356 | 5/1985 | Lambert | 528/483 |
| 4,548,895 | 10/1985 | Irving et al. | 320/214 |

FOREIGN PATENT DOCUMENTS

| | | | |
|---|---|---|---|
| 1102276 | 6/1981 | Canada | 204/91.33 |
| 852307 | 5/1983 | Japan . | |

OTHER PUBLICATIONS

Danielson, R. D., "Vapor Phase Soldering with Perfluorinated Inert Fluids", *Proc. Technical Program,* Nepco '79, Anaheim, CA pp. 374–382 (Feb. 27–Mar. 1, 1979).

Mathias, E., "Solventless Radiation Curable Conductive Inks", *Radcure* '84 Conference Proceedings, Association for Finishing Processes/SME, Atlanta, GA pp. 13-1 to 13-22 (Sep. 10, 1984).

Mathias, E., "Radiation: A Cure for PTF Inks", *Circuits Manufacturing,* pp. 75–76 (Feb., 1986).

E. J. Deviny, "Radiation-Induced Cationic Polymerization-UV Curable Epoxy-Based Coatings for Metal Decorating", *3rd International conference on Radiation Curing,* Association for Finishing Processes/SME, Paper FC-76-503, Chicago, IL (Sep. 28, 1987).

W. R. Watt, "UV Curing of Epoxides by Cationic Polymerization", *Radiation Curing,* 13, 4, pp. 7–25 (Nov., 1986).

R. D. Danielson, "Fluoro Ether and Amino", *Kirk-Othmer Encyclopedia of Chemical Technology,* 3rd Ed. 10, p. 875, John Wiley and Sons (N.Y. 1980).

*Handbook of Epoxy Resins,* McGraw-Hill Book Co., N.Y. (1967).

*Epoxy Resin Technology,* John Wiley and Sons, N.Y. (1968).

*Primary Examiner*—Bernard Pianalto

*Attorney, Agent, or Firm*—Donald M. Sell; Walter N. Kirn; Eloise J. Maki

[57] ABSTRACT

Coatings are cured by simultaneous exposure to radiant energy and condensing inert perfluorochemical vapors.

7 Claims, 2 Drawing Sheets

METHOD FOR CURING AN ORGANIC COATING USING CONDENSATION HEATING AND RADIATION ENERGY

This is a division of application Ser. No. 140,024, filed Dec. 31, 1987.

TECHNICAL FIELD

This invention relates to a method for curing an organic coating using condensation heating. This invention also relates to cured coatings and to a curing apparatus.

BACKGROUND ART

Several publications describe the curing of resin coatings using condensation heating. For example, R. D. Danielson, "Vapor Phase Soldering with Perfluorinated Inert Fluids", *Proc. Technical Program*, Nepcon '79, Anaheim, Calif., pp. 374–382 (Feb. 27–Mar. 1, 1979) suggests curing resin coatings using a vapor phase soldering apparatus. U.S. Pat. No. 4,517,356 (Lambert et al.) reports using condensation heating to cure thermosetting conductive epoxide inks. Japanese Pat. Application No. 85-23074 describes the use of condensation heating to crosslink cable insulation. Two papers by Mathias et al., "Solventless Radiation Curable Conductive Inks", *Radcure* '84 *Conference Proceedings*, Association for Finishing Processes/SME, Atlanta, Ga., pp. 13-1 to 13-22 (Sept. 10, 1984), and "Radiation: A Cure for PTF Inks", *Circuits Manufacturing*, pp. 75–76 (February, 1986), describe the use of condensation heating at vapor temperatures of 155° C. and 215° C. to cure solventless, conductive, acrylate-based radiation-curable inks that were modified to be curable with heat alone. Mathias et al. reported poor results using inert perfluorochemical liquids that boiled at 101° C., and attributed this to an inadequate heating rate. Mathias et al. also mentioned the use of other heating methods to cure their inks, and stated that these inks did not require lengthy predrying and could be cured directly with either ultraviolet (UV) radiation, heat or a combination of both. However, Mathias et al. did not specify which manner of heating should be used in such a combination and did not exemplify any combinations of condensation heating and UV radiation.

There are a number of publications that describe methods for curing compositions using a combination of radiant energy and heat from a typical heat source (e.g., an oven). Among such publications are U.S. Pat. Nos. 4,246,298 (Guarnery et al.), 4,288,527 (Morgan), 4,444,806 (Morgan et al.) and 4,548,895 (Irving et al.); others include E. J. Deviny, "Radiation-Induced Cationic Polymerization-UV Curable Epoxy-Based Coatings for Metal Decorating", 3rd *International Conference on Radiation Curing*, Association for Finishing Processes/SME, Paper FC-76-503, Chicago, Ill. (Sept. 28, 1976), and W. R. Watt, "UV Curing of Epoxides by Cationic Polymerization", *Radiation Curing*, 13, 4, pp. 7–25 (November, 1986). The Guarnery et al. patent and the Watt article note that the epoxy-based systems they described did not cure above about 120°–130° C.

SUMMARY OF THE INVENTION

This invention provides a method for curing a free-radically-polymerizable or cationically-polymerizable radiation-curable organic coating composition, comprising the steps of (A) coating said composition on a substrate, and then simultaneously, in the case of free-radically-polymerizable composition, or sequentially in either order or simultaneously, in the case of cationically-polymerizable compositions, (B) exposing said coating to condensation heating in condensing inert perfluorochemical vapors (CIPV) and (C) exposing said coating to radiant energy, whereby said coating is cured to a solvent-resistant state.

The use of condensation heating and radiant energy according to the invention provides several advantages, including:

1. Rapid heating of the coating to the temperature of the boiling perfluorochemical fluid;

2. Displacement of air (oxygen) from the surface of the coating, thus reducing the risk of fire or explosion when curing coatings containing flammable solvents, and eliminating oxygen inhibition of free-radical-polymerizable coatings; and 3. Greater degree of cure than is conveniently obtainable using condensation heating alone, radiant energy alone, or combinations of radiant energy and heating methods other than condensation heating.

DETAILED DESCRIPTION

Figure 1:
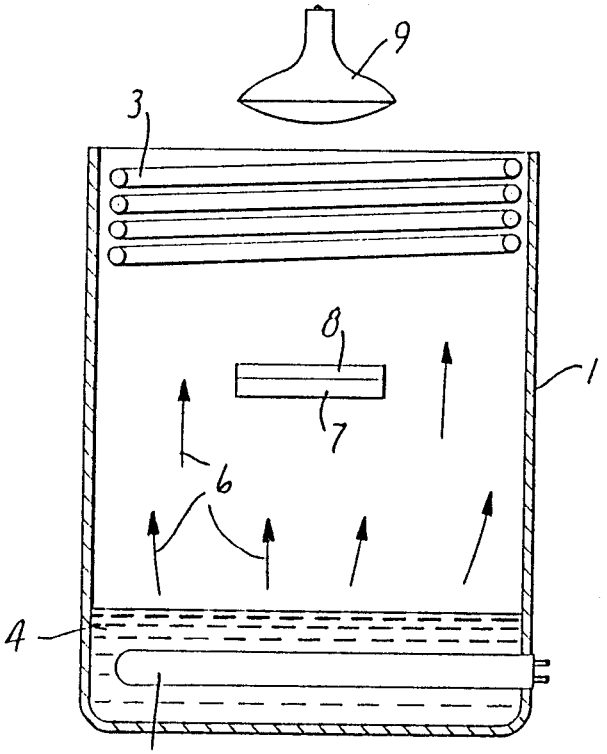
FIG. 1 is a sectional view of an apparatus for practicing the invention on a single article or a batch of articles.

The radiation-curable organic coating compositions that are cured by the method of the invention contain one or more organic monomers, oligomers or prepolymers having one or more free-radically-polymerizable functional groups and/or one or more cationically-polymerizable functional groups. The coating compositions can optionally contain one or more appropriate photocatalysts and/or photoinitiators capable of curing the composition upon exposure to radiant energy of a suitable wavelength and intensity. A photocatalyst or photoinitiator is not required when a radiant energy source of sufficiently high flux density (e.g., electron beam radiation) is employed. The coating compositions can be used as paints, adhesives, masks, inks (e.g., the so-called polymer thick film or "PTF" inks), abrasion-resistant coatings, weather-resistant coatings (e.g., coatings for outdoor signs), insulative coatings, and the like. The method of the invention is especially preferred for use with abrasion-resistant and weather-resistant coatings, since the enhanced degree of cure provided by the invention yields an especially durable coating.

Preferred free-radically-polymerizable coating compositions are capable of being cured to a solvent-resistant state (i.e., a state in which the coating is not removed by multiple rubs of a swab saturated with a solvent for the uncured coating, e.g., 2-butanone) upon exposure to a suitable source of free radicals, e.g., a peroxide catalyst. Suitable compositions are widely known and commercially available, and include monomers such as ethoxyethoxyethyl acrylate, phenoxyethyl acrylate and methacrylate, isobornyl acrylate, tetrahydrofurfuryl acrylate and methacrylate, and isooctyl acrylate. Other free-radical-polymerizable monomers include ethylenically unsaturated compounds such as N,N-dimethylacrylamide, N-isobutylacrylamide, diacetoneacrylamide, N-methoxymethylacrylamide, N-butoxymethylacrylamide and methacrylamide, styrene, dichlorostyrene, divinylbenzene, vinyl toluene, N-vinyl-pyrrolidone, N-vinylpiperidone, N-vinylcaprolactam and N-vinylcarbazole. Free-radically-polymerizable prepolymers useful in the invention include acrylate and methacrylate esters of polyols (e.g., esters of aliphatic polyols, polyether polyols, polyester polyols, and polyurethane polyols), reaction products of polyfunctional epoxides with acrylic or methacrylic acid, reaction products of polyols with isocyanatoethyl acrylate or methacrylate, reaction products of polyisocyanates with hydroxyalkyl acrylates or methacrylates, and reaction products of polycarboxylic anhydrides with hydroxyalkyl acrylates or methacrylates. Mixtures of monomers, oligomers or prepolymers can also be used if desired, e.g., to modify the properties of the coating.

The free-radically-polymerizable monomers, oligomers or prepolymers can also be combined with ethylenically unsaturated compounds that by themselves do not homopolymerize under free radical polymerization conditions. Such compounds include non-terminally-unsaturated polyesters (e.g., polyesters derived from diols and unsaturated dicarboxylic acids, such as itaconic, maleic, or fumaric acids), allyl amides, allyl esters, allyl ethers, and vinyl ethers. Representative compounds include triallylisocyanurate, diallylphthalate, diallyladipate, diallylmaleate, diallylitaconate, triallylcitrate, trimethylolpropane diallyl ether, trimethylolpropane triallyl ether, pentaerythritol triallyl ether, isobutyl vinyl ether, octadecyl vinyl ether, hexanediol divinyl ether, triethyleneglycol divinyl ether, di-2-vinyloxyethyl ether of Bisphenol A, trimethylolpropane trivinyl ether, and mixtures thereof.

Preferred cationically-polymerizable coating compositions are capable of being cured to a solvent-resistant state when in the presence of a suitable catalyst for cationic polymerization, e.g., Bronsted acids, their precursors, or Lewis acid complexes. Suitable compositions are widely known and commercially available, and include monomers such as the vinyl ethers described above, and oxirane-group containing (epoxy-containing) monomers, oligomers and prepolymers such as those described in U.S. Pat. Nos. 3,117,099 (Proops et al.), 4,329,478 (Behr) and 4,394,403 (Smith), the disclosures of which are incorporated herein by reference, and in Lee and Neville, *Handbook of Epoxy Resins*, McGraw-Hill Book Co., New York (1967) and Bruins, *Epoxy Resin Technology*, John Wiley and Sons, New York (1968), the epoxy resin disclosures of which are incorporated herein by reference.

The cationically-polymerizable compounds can also be combined with copolymerizable organic compounds that by themselves do not homopolymerize under cationic polymerization conditions. Hydroxyl compounds are preferred copolymerizable compounds, such as those described in U.S. Pat. No. 4,318,766 (Smith).

The coating composition can contain bireactive monomers, oligomers or prepolymers having attached thereto at least one free-radically-polymerizable moiety and at least one cationically-polymerizable moiety. Illustrative bireactive monomers, oligomers or prepolymers include the partially acrylated or methacrylated polyfunctional epoxides described in U.S. Pat. No. 4,428,807 (Lee et al.), the disclosure of which is incorporated herein by reference. A representative bireactive prepolymer can be made by reacting one mole of Bisphenol A diglycidyl ether or one mole of butanediol diglycidyl ether with one mole of acrylic acid. Other representative bireactive monomers, oligomers or prepolymers include 3-(methacryloxy)propyl trimethoxysilane, glycidyl acrylate, the reaction product of glycidol with isocyanatoethyl methacrylate, the reaction product of two moles of Bisphenol A diglycidylether with one mole of itaconic acid, and the like.

Photocatalysts or photoinitiators for use in the coating compositions of the invention are well known and widely available. Representative free radical photocatalysts or photoinitiators useful with free-radically-polymerizable compositions include mono- or diketones such as benzophenone and camphorquinone, benzoin derivatives such as its benzoin ethyl ether, benzil derivatives such as its dimethylketal, $\alpha$-substituted acetophenones such as diethoxy acetophenone and $\alpha$-hydroxy-$\alpha,\alpha$-dimethylacetophenone, and halomethyl-s-triazines such as 2,4-bis(trichloromethyl)-6-p-methoxystyryl-s-triazine. These photocatalysts or photoinitiators can be used alone or in combination with heat-activated initiators. Representative heat-activated initiators include diacyl peroxides such as benzoyl peroxide, dialkyl peroxides such as dicumyl peroxide, hydroperoxides such as t-butyl hydroperoxide, peroxyesters such as t-butyl perbenzoate, and pinacols such as benzopinacol.

Representative cationic photocatalysts or photoinitiators include "onium" salts of complex halogenides, e.g., the phenyldiazonium hexafluorophosphates containing alkoxy or benzyloxy radicals as substituents on a phenyl radical described in U.S. Pat. No. 4,000,115 (Jacobs), and the diaryliodonium and triarylsulfonium metal complex salts described in U.S. Pat. Nos. 3,981,897 (Crivello), 4,058,401 (Crivello), 4,101,513 (Fox et al.), 4,169,478 (Crivello), 4,173,476 (Smith et al.) and 4,394,403 (Smith), the disclosures of which are incorporated herein by reference. Illustrative onium salts are diphenyliodonium hexafluorophosphate, triphenylsulfonium hexafluoroantimonate, and diphenyl-4-thiophenoxyphenyl-sulfonium hexafluoroantimonate. If desired, optical sensitization to longer wave lengths of light may be performed as described in U.S. Pat. Nos. 4,026,705 (Crivello et al) and 4,069,054 (Smith), the disclosures of which are incorporated herein by reference. Experience has shown that the amount of photocatalyst or photoinitiator in the coating composition can vary over a wide range, since the photocatalyst or photoinitiator is substantially inert unless photoactivated. A preferred amount of photocatalyst or photoinitiator is about 0.02% to about 10% by weight based on the total weight of the coating composition, more preferably about 0.1% to about 5% by weight.

The coating compositions can contain conventional non-reactive solvents such as toluene, 2-butanone, propyl acetate, and the like, and can also contain conventional reactive solvents such as butyl acrylate, butyl glycidyl ether, and the like. The compositions can also contain conventional adjuvants such as dyes, pigments, indicators, flatting agents, lubricants, dispersing aids, surfactants, extenders, viscosity modifiers, non-electrically conductive fillers (e.g., calcium carbonate, quartz, diatomaceous silica, synthetic silica, talc, mica, bentonite, glass fibers, white lead, antimony oxide, lithopone or titanium dioxide), or electrically conductive fillers (e.g., silver, gold or copper).

Substrates on which the coating composition can be applied include rigid or flexible materials such as primed or unprimed metals (e.g. steel, copper, aluminum or tinplate), plastic sheets and films (e.g., polyester, polycarbonate, epoxy, polypropylene or polyvinylchloride), composites (e.g., epoxy-glass or epoxy-graphite laminates), glass, ceramics, fibrous substrates (e.g., nonwoven materials or woven fabrics formed from natural or synthetic fibers or mixtures thereof) and laminates of the foregoing materials. Coated articles that can be made by coating such substrates include circuit boards and connectors, printing plates, container bodies and closures, vehicle bodies and component parts, metal coil goods (e.g. building siding), floor tile, and the like.

The coating of substrates with the coating composition can be carried out by conventional methods, depending on factors such as the nature of the coating composition, the nature of the substrate to be coated, and the desired properties and shape or configuration of the final coated article. Suitable coating methods include brushing, dipping, spraying, knife coating, bar coating, gravure coating, curtain coating and the like. Coating thickness will vary depending on the above-described factors, but will generally be in the range of about 0.1–10 mils (2.5 to 250 microns).

The coating composition is preferably condensation heated within a substantially closed apparatus in order to contain the condensation heating vapor, and permit recycling of the condensation heating liquid. The apparatus for curing can be made by modifying vapor phase soldering equipment to include a radiant energy source. For example, U.S. Pat. No. 3,866,307 (Pfahl et al.) describes equipment suitable for condensation heating a coated article, a batch of articles or a continuously moving belt bearing such articles. The Pfahl et al. equipment can be modified for use in this invention by adding a suitable radiant energy source inside the equipment, or by placing the source outside the equipment in a manner that will allow the radiant energy to irradiate a substrate within the equipment. Other vapor phase heating equipment that can be modified for use in this invention is shown in the Danielson paper and in the Lambert et al. patent, both of which are cited above.

Referring now to the drawing, FIG. 1 shows a preferred apparatus for use in curing coatings on a single article or a batch of articles using UV and CIPV. The apparatus contains a chamber or vessel 1 having a heating coil 2 or other means for heating and boiling the inert perfluorochemical liquid 4. Cooling coils 3 for condensing the hot perfluorochemical vapors 6 are located in the upper portion of the vessel 1. Coating 8 on substrate 7 is cured by exposure to the vapors 6 and radiant energy from energy source 9. Used fluids can be recovered and purified by conventional procedures, e.g., filtration and distillation. Exhaust means for the curing apparatus are recommended to exhaust any by-product decomposition products or low boiling monomers from the fluid or coating composition.

Figure 2:
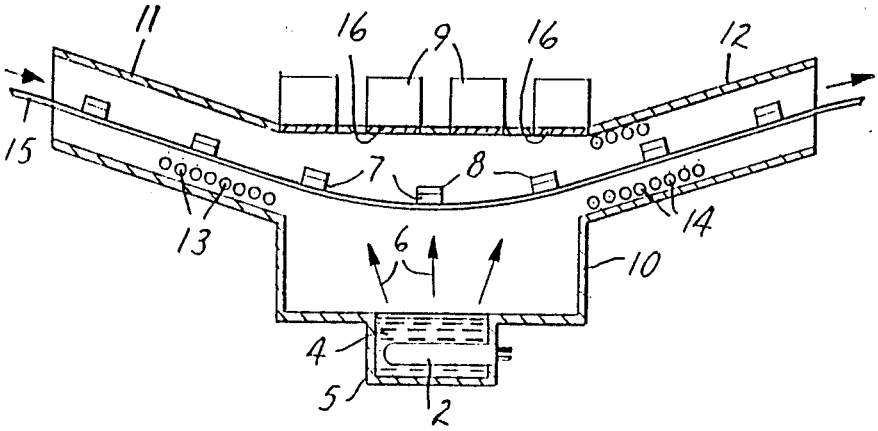
FIG. 2 is a sectional view of an apparatus for practicing the invention on a continuously moving belt bearing such articles.

FIG. 2 shows a preferred apparatus for use in curing coatings on articles placed on a continuously moving belt. Vessel 10 has a lower portion containing a reservoir 5 filled with inert perfluorochemical liquid 4 and heated by heater 2. Cooling coils 13 and 14 for condensing the hot perfluorochemical vapors 6 are located in the inlet 11 and outlet 12 of the upper portion of vessel 10. Coating 8 on substrate 7 is carried through vessel 10 on continuously moving belt 15. Coating 8 is cured by vapors 6 and radiant energy from energy sources 9 passing through windows 16 (made, for example, from quartz).

Figure 3:
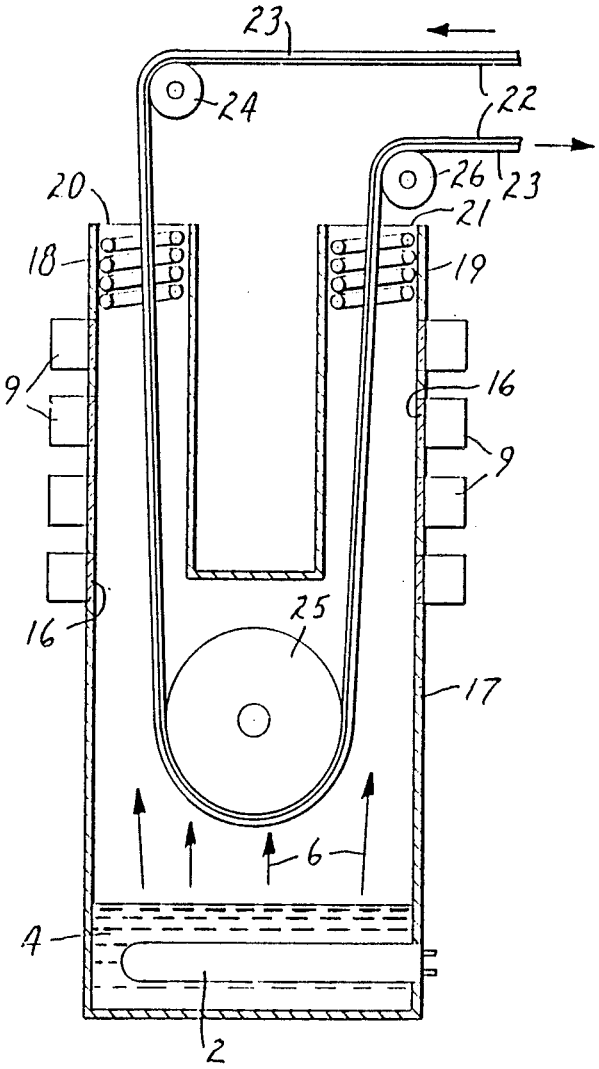
FIG. 3 is a sectional view of an apparatus for practicing the invention on a continuously moving coated web.

FIG. 3 shows a preferred apparatus for curing a coating on a continuously moving web. The lower portion of vessel 17 contains heater 2 for boiling inert perfluorochemical liquid 4. Cooling coils 18 and 19 for condensing the hot perfluorochemical vapors 6 are located in the inlet 20 and outlet 21 of the vessel 17. Continuously moving web 22 bearing coating 23 moves over rollers 24, 25 and 26 through vessel 17. Coating 23 is cured by vapors 6 and radiant energy from energy sources 9 passing through windows 16.

The preferred inert perfluorochemical liquids used to produce condensing vapors for heating and thermally polymerizing the coating composition include perfluoroalkanes such as perfluorooctane, perfluorotrialkylamines such as perfluorotributylamine, and perfluorodialkylethers such as perfluorodibutyl ether. Many useful liquids are commercially available and include "FLUORINERT" electronic liquids from 3M, "FREON E" liquids from E. I. duPont de Nemours & Co., "FLUTEC PP" liquids from ISC Chemicals Limited, and "GALDEN HS" liquids from Montedison, Inc.

A list of preferred inert perfluorochemical liquids and their boiling points is shown below. The boiling point data is taken from R. D. Danielson, "Fluoro Ethers and Amines", *Kirk-Othmer Encyclopedia of Chemical Technology,* 3rd Ed., 10, p. 875, John Wiley & Sons (N.Y., 1980).

| Liquid | Boiling point, °C. |
|---|---|
| Perfluoro-4-methylmorpholine | 51 |
| Perfluorotriethylamine | 71 |
| Perfluoro-2-ethyltetrahydrofuran | 56 |
| Perfluorohexane | 58 |
| Perfluoro-4-isopropylmorpholine | 95 |
| Perfuorodibutyl ether | 102 |
| Perfluorooctane | 103 |
| Perfluorotripropylamine | 130 |
| Perfluorononane | 123 |
| Perfluorotributylamine | 178 |
| Perfluorodihexyl ether | 181 |
| Perfuorotetrahydrophenanthrene | 215 |

The selection of a specific inert perfluorochemical liquid or mixture of liquids will typically be governed by the particular coating composition to be cured and by the nature of the substrate, and will generally be determined empirically. Of course, availability and cost of the liquids are also important factors.

The radiant energy source can be visible light, UV light, electron beam radiation, or a combination thereof. UV light is the preferred radiant energy source. UV light can be supplied by sun lamps, high or medium pressure mercury lamps, xenon lamps, mercury xenon lamps, lasers, and other well known sources. Lamps may be long arc or short arc, and can be water- or air-cooled. The lamps can include envelopes capable of transmitting light of a wavelength of from about 185 nm to 400 nm. The lamp envelope can be made of quartz, such as "Spectrocil" or of glass, such as "Pyrex". Typical commercially available UV lamps include medium pressure mercury arcs such as the GE "H3T7" arc and the Hanovia 200 watt/inch arc lamp. The lamps, if positioned within the condensation heating apparatus, preferably are arranged so as to irradiate the coating composition evenly and completely. In a particularly useful arrangement, the radiant energy source is placed at the top of the condensation heating apparatus and directed downward upon the substrate to be irradiated.

Cure times for condensation heating and radiant energy exposure will vary depending on the coating composition, coating thickness, the temperature of the condensation heating vapor and the radiant energy intensity or flux. However, very fast coating cure times, e.g., less than 60 seconds and as short as 15 seconds or less can be obtained for selected coating compositions using the method of this invention.

The vapors were prevented from escaping the vessel by 5 cm high cooling coils at the top of the vessel. Immersion in the perfluorinated vapor continued during UV exposure.

Cure progress for each coating was determined by monitoring disappearance of the 1405 $cm^{-1}$ acrylate group infrared absorption band. The results are set out below in Table I.

TABLE I

| UV exposure time (min.) | Percent Acrylate Reaction: Condition (1)-UV cure in fluorocarbon liquid | UV cure in ambient air: Condition (2)-Room | UV cure in ambient air: Condition (3)-Vessel | Condition (4) UV cure in 55-60° C. air | Condition (5) UV cure in 57° C. vapor |
|---|---|---|---|---|---|
| .08 | — | — | — | — | 51 |
| .17 | — | — | — | — | 56 |
| .33 | — | — | 31 | 42 | 58 |
| .67 | — | — | 37 | 49 | 60[c] |
| 1 | 22 | 35 | 40 | 53 | 62 |
| 2 | 29 | 40 | 46 | 58[b] | 64 |
| 5 | 38 | 47 | 52 | 64 | 67 |
| 10 | 41 | 52 | 58 | — | 70 |
| 15 | 43 | 53 | 60[a] | — | 71 |

[a]Ambient temperature reached 59° C. due to UV lamp.
[b]A coating, similarly applied to a 5 cm × 7.6 cm × 1 mm thick glass plate and cured, lost 25% of its weight and had a dull-looking surface after 100 double rubs with a 2-butanone-saturated cotton swab.
[c]The effect of 2-butanone treatment as in b was <10% loss of weight along coating edges only and retention of gloss.

The following examples will further illustrate the invention, but are not to be construed as limiting its scope. Unless otherwise indicated, all parts and percentages are by weight.

EXAMPLE 1

This example illustrates the simultaneous use of condensation heating and UV to cure a diacrylate resin. 200 Parts of a 75% solids solution of "Epocryl 370" bisphenol A diglycidylether diacrylate (Shell Chemical Co.) in toluene was mixed with 15 parts of a 20% solids solution of "Irgacure 651" photoinitiator (Ciba-Geigy Co.) in toluene. Coatings of the resulting mixture were applied with a #10 wire wound rod to sodium chloride plates and allowed to air dry for at least 15 minutes. The coatings were exposed to UV light from a 275 watt sunlamp placed 12.7 cm above the coatings. Photopolymerization and optional thermal polymerization of the coatings were conducted under five different conditions:

(1) Coatings were immersed under a 6.4 mm liquid layer of mixed perfluorooctane/perfluoro-2-butyltetrahydrofuran in the vessel 1 shown in FIG. 1. The vessel was made from insulated stainless steel and had a 20 cm inside diameter and a 23 cm depth. The liquid was at ambient temperature (about 24° C.).

(2) Coatings were placed on a flat surface and exposed to UV while surrounded by room air at ambient temperature.

(3) Coatings were placed in the vessel and exposed to UV while surrounded by room air at ambient temperature.

(4) Coatings were placed in the vessel and heated to 55°-60° C. in air for a 10 minute dwell period, then exposed to UV. The air in the vessel was heated using a hotplate.

(5) Coatings were placed in the vessel and heated to 57° C. by immersion in the saturated vapor of perfluorohexane during a 1 minute dwell period, then exposed to UV. About 8 cm of vapor covered the samples.

The above data illustrates that use of both UV and condensation heating (Condition 5) provided faster or more complete cure than use of both UV and ambient temperature fluorocarbon liquid (Condition 1), UV and ambient air (Conditions 2 and 3), or UV and heated air (Condition 4).

COMPARISON EXAMPLE 1

This comparison example illustrates the use of condensation heating alone in the thermal free radical curing of a diacrylate resin. Coated sodium chloride plates were prepared as in EXAMPLE 1, but using 15 parts of a 20% solids solution of benzoyl peroxide in 2-butanone in place of the Irgacure 651 photoinitiator solution. Thermal polymerization of the coatings was conducted under four different conditions, using the apparatus of EXAMPLE 1, condition (3). The four heating conditions used in this comparison example were:

(1) 130° C. forced air, (2) 82° C. saturated vapor of perfluoroheptane, (3) 102° C. saturated vapor of mixed perfluorooctane/perfluoro-2-butyltetrahydrofuran, or (4) 130° C. saturated vapor of mixed perfluoro-N,N-dibutyl-N-methylamine/perfluoro-N-butylpiperidine.

The results are set out below in Table II.

TABLE II

| Heating time (min.) | Percent Acrylate Reaction: Condition (1) 130° C. air | Condition (2)-82° C. Fluoro-chemical vapor | Condition (3)-102° C. Fluoro-chemical vapor | Condition (4)-130° C. Fluoro-chemical vapor |
|---|---|---|---|---|
| 0.5 | — | 4 | 30 | 61 |
| 1 | — | 7 | 45 | 72 |
| 2 | 4 | 14 | 55 | 77 |
| 3 | 5 | 21 | 60 | 78 |
| 5 | 6 | 33 | 65 | 78 |
| 10 | 9 | 46 | 70 | 78 |
| 100 | 20 | — | — | — |

The above data illustrates that when condensation heating was used alone, substantially higher temperatures or longer heating times typically were required to obtain a degree of cure comparable to that obtained by the use of both UV and condensation heating.

EXAMPLE 2

Coatings were prepared as described in EXAMPLE 1 except that the concentration of photoinitiator was reduced to one fourth the concentration employed in EXAMPLE 1. Using the method of EXAMPLE 1, simultaneous thermal polymerization and photopolymerization of the coatings was conducted under the following three conditions:

(1) 100°–105° C. ambient air, (2) 57° C. saturated vapor of perfluorohexane, or (3) 102° C. saturated vapor of mixed perfluorooctane/perfluoro-2-butyltetrahydrofuran.

The results are set out below in Table III.

TABLE III

| UV exposure time (min.) | Percent Acrylate Reaction: Condition (1) UV cure in 100–105° C. air | Condition (2) UV cure in 57° C. vapor | Condition (3) UV cure in 102° C. vapor |
|---|---|---|---|
| .08 | — | 40 | 50 |
| .17 | — | 45 | 59[b] |
| .33 | — | 47 | 61 |
| .67 | 4 | 51 | 65 |
| 1 | 7 | 54[a] | 68 |
| 2 | 13 | 58[a] | 72 |
| 5 | 20 | 60 | 74 |
| 10 | 30 | 61 | 75 |

[a]After 1.25 minutes irradiation, a 2-butanone treatment (as in Table I, footnote b) resulted in 20% loss of weight along coating edges only and retention of gloss.
[b]Using the procedure described in a, an observed weight loss less than 10% was obtained along the coating edges only. Coating gloss was retained.

The above data illustrates that the method of the invention enables a substantial degree of cure to be obtained after even very short processing times.

EXAMPLE 3

This example describes the UV curing of a blend of an ethylenically-unsaturated cellulose ester derivative and an ethylenically unsaturated ester with optional simultaneous or prior thermal polymerization by condensation heating. A coating formulation was prepared by mixing 80 parts of a 35% solids solution of a 1:1 equivalent adduct of isocyanatoethyl methacrylate and the hydroxyl groups of cellulose acetate propionate ("504-0.2", Eastman Chemical Co.) in propyl acetate, 20 parts of a 75% solids solution of a 1:1 equivalent adduct of isocyanatoethyl methacrylate and the hydroxyl groups of the acrylic acid esterification produce formed from a 1:2 molar ratio reaction of itaconic acid with bisphenol A diglycidylether ("DER-332", Dow Chemical Co.), and 8.6 parts of a 20% solids solution of "Irgacure 184" photoinitiator (Ciba-Geigy Co.) in toluene. The resulting mixture was applied with a #16 wire wound rod to sodium chloride plates and allowed to air dry for at least 15 minutes prior to irradiation.

The coatings were photopolymerized by exposure to UV light from a 275 watt sunlamp placed 12.7 cm above the coatings. Photopolymerization and optional simultaneous or prior thermal polymerization of the coatings was conducted under three conditions:

(1) surrounded by room air at ambient temperature, (2) photopolymerized simultaneously with immersion in the 102° C. saturated vapor of mixed perfluorooctane/perfluoro-2-butyltetrahydrofuran, or (3) photopolymerized in the CIPV atmosphere described in (2) except that the coatings were allowed to reach the CIPV temperature by immersion for a 1 minute dwell time in the saturated vapor prior to photopolymerization.

Cure progress was determined by monitoring disappearance of the 1630 $cm^{-1}$ methacrylate group infrared absorption band. The results are set out below in Table IV.

TABLE IV

| UV exposure time (min.) | Percent Methacrylate Reaction: Condition (1) UV cure in ambient air | UV cure in 102° C. Vapor: Condition (2) No preheat | Condition (3) preheat |
|---|---|---|---|
| .08 | — | 30 | 59 |
| .25 | — | 54 | 62 |
| .50 | — | 60[b] | 66 |
| 1 | 17 | 67[c] | 70 |
| 5 | 34 | — | 76 |
| 10 | 44[a] | — | — |

[a]Rubbing with a cotton swab saturated with 2-butanone caused dissolution of the coating surface and left a dull surface finish.
[b]Rubbing as in a caused only formation of a slight surface haze.
[c]Rubbing as in a caused no effect on the coating.

EXAMPLE 4

Three coating compositions were prepared so that a comparison could be made between free-radically-polymerizable and cationically-polymerizable compositions. Coating 4-1 was the same coating formulation used in Example 3. Coating 4-2 was prepared by mixing 89 parts of a 20% solids solution of cellulose acetate propionate ("504-0.2", Eastman Chemical Co.) in 3:1 n-propyl acetate:ethanol, 11 parts cycloaliphatic diepoxide ("ERL-4221", Union Carbide Co.), and 5.8 parts of a 20% solids solution of triarylsulfonium hexafluoroantimonate photoinitiator in 2-butanone. Preparation of the photoinitiator is further described in U.S. Pat. No. 4,173,476 (Smith et al.). The resulting mixture contained epoxide and hydroxyl groups in a 3:2 molar ratio. Coating 4-3 contained the same three solid ingredients employed in Coating 4-2 but in a weight ratio of 92.4:7.6:5.2, respectively, so that the molar ratio of epoxide to hydroxyl groups was 1:1. Each coating was applied to a 5 cm × 7.6 cm × 1 mm thick glass plate using a wire wound rod. A #16 rod was used for coating 4-1 and a #32 rod was used for coatings 4-2 and 4-3 so that the dry film thicknesses were approximately equivalent. The coatings were allowed to air dry for 15 minutes prior to irradiation.

The coatings were photopolymerized by exposure to UV light from a 275 watt sunlamp placed 12.7 cm above the coatings. Photopolymerization and optional thermal polymerization of the coatings was conducted under four conditions:

(1) surrounded by room air at ambient temperature, (2) photopolymerized simultaneously with immersion in the 82° C. saturated vapor of perfluoroheptane, (3) photopolymerized simultaneously with immersion in the 102° C. saturated vapor of mixed perfluorooctane/perfluoro-2-butyltetrahydrofuran, or (4) photopolymerized simultaneously with immersion in the 130° C. saturated vapor of mixed perfluoro-N,N-dibutyl-N-methylamine/perfluoro-N-butylpiperidine.

After UV exposure, each coating was cooled to ambient temperature using forced air.

Cure progress was monitored by determining the weight loss of each film after 100 double rubs with a 2-butanone-saturated cotton swab as a function of irradiation time. A benchmark condition of cure was arbitrarily chosen as that UV exposure time yielding a 10% observed or interpolated coating weight loss. The results are set out below in Table V.

TABLE V

| | Seconds to 10% Weight Loss | | | |
|---|---|---|---|---|
| Coating composition | Condition (1)-UV cure in ambient air | Condition (2)-UV cure in 82° C. vapor | Condition (3)-UV cure in 102° C. vapor | Condition (4)-UV cure in 130° C. vapor |
| 4-1 | 1500 | 10 | 8 | 5 |
| 4-2 | >1500 | 75 | 16 | 8 |
| 4-3 | >>1500 | 120 | 24 | 13 |

The above data illustrates that use of higher condensation heating temperatures shortens the time to reach a solvent resistant state even for cationicallypolymerizable epoxide-crosslinked polyol formulations.

EXAMPLE 5

This example illustrates the use of the invention to cure a coating composition containing two different polymerizable groups, one of which is subject to oxygen inhibition during cure. Bisphenol A diglycidylether ("Epon 828", Shell Chemical Co.) was reacted with acrylic acid, at an equivalent ratio of 0.5 moles acrylic acid per mole of epoxide groups. 200 parts of an 85% solution of the resulting reaction product in toluene were mixed with 17 parts of a 20% solution of triarylsulfonium hexafluoroantimonate photoinitiator in 2-butanone.

The coatings were applied to sodium chloride plates as in EXAMPLE 1. The coatings were then photopolymerized in ambient air (using the method of EXAMPLE 1) and optionally further thermally polymerized in the 102° C. saturated vapor of mixed perfluorooctane/-perfluoro-2-butyltetrahydrofuran. Cure progress was determined by monitoring disappearance of the 915 $cm^{-1}$ epoxide and 1405 $cm^{-1}$ acrylate group infrared absorption bands. Solvent resistance was evaluated by wiping the coatings with up to 20 rubs of a 2-butanone-saturated cotton swab. The polymerization conditions and the results are set out below in Table VI. Runs 1a and 1c in the table represent successive observations made on a first sample. Runs 2a-2b, 3a-3c, and 4a-4b in the table likewise represent successive observations made on second, third, and fourth samples, respectively.

TABLE VI

| | Polymerization time (min.) | | | | |
|---|---|---|---|---|---|
| Run No. | UV cure in ambient air | Thermal cure in 102° C. vapor | UV and thermal cure in 102° C. vapor | Percent Reaction Epoxide | Percent Reaction Acrylate |
| 1a | 0.5[a] | 0 | — | 65 | 0 |
| 2a | 2[b] | 0 | — | 91 | 1 |
| 1b | 0.5 | 1[c] | — | 98 | 11 |
| 1c | 0.5 | 5 | — | 96 | 16 |
| 2b | 5 | 5[d] | — | 96 | 47 |
| 3a | 0.5 | — | 0 | 72 | 1 |
| 3b | 0.5 | — | 1 | 96 | 52 |
| 3c | 0.5 | — | 5 | 97 | 64 |

TABLE VI-continued

| | Polymerization time (min.) | | | | |
|---|---|---|---|---|---|
| Run No. | UV cure in ambient air | Thermal cure in 102° C. vapor | UV and thermal cure in 102° C. vapor | Percent Reaction Epoxide | Percent Reaction Acrylate |
| 4a | — | — | 0.25 | 95 | 45 |
| 4b | — | — | 1 | 94 | 64 |

[a]Tacky
[b]Nontacky but solvent soluble.
[c]Solvent swellable.
[d]Solvent resistant.

The above data illustrates not only the reduction in required total polymerization time attained by using simultaneous condensation heating and UV, but also the degree of control that can be attained when curing specific reactive groups.

EXAMPLE 6

This example illustrates the effect of alteration of the photoinitiator and polymerization conditions. Three coating formulations were prepared and identified as formulation "C", "R" or "CR". Formulation C was identical to that of EXAMPLE 5. Formulation R was like formulation C except that the photoinitiator was replaced with an equal weight of "Irgacure 651" photoinitiator (Ciba-Geigy Co.). Formulation CR was made from a 1:1 blend of formulation C and formulation R.

Coatings were prepared and evaluated using the method of EXAMPLE 5. The results are set out below in Table VII.

TABLE VII

| Polymerization time (min.) | | | | | | | | |
|---|---|---|---|---|---|---|---|---|
| UV cure in ambient air | Thermal cure in 102° C. vapor | UV and thermal cure in 102° C. vapor | Percent Reaction Epoxide C | Epoxide CR | Epoxide R | Acrylate C | Acrylate CR | Acrylate R |
| 0.5 | — | — | 65 | 52 | 0 | 0 | 22 | 31 |
| 2 | — | — | 91 | — | 0 | 1 | — | 37 |
| 0.5 | 1 | — | 98[a] | 94[b] | — | 11[a] | 30[b] | — |
| — | — | 0.25[c] | 95 | 79 | — | 45 | 69 | — |

[a]Nontacky but solvent removable.
[b]Solvent resistant.
[c]About 72% of reactive groups were polymerized. The epoxide to acrylate conversion ratio was about 2:1 for C but about 1:1 for CR, yielding two different polymeric structures.

EXAMPLE 7

This example illustrates a structural adhesive application for coating compositions like those described in EXAMPLE 5 and EXAMPLE 6. A solventless coating composition was prepared by dissolving 3 parts of the triarylsulfonium hexafluoroantimonate photoinitiator used in EXAMPLE 5 in a mixture of 160 parts of the half-acrylated diepoxide used in EXAMPLE 5 and 40 parts glycidyl methacrylate. The resulting fluid composition was coated onto a 5 cm×7.6 cm×1 mm thick glass plate using a #32 wire wound rod and exposed to UV for 3 minutes in room air using a 275 watt sunlamp placed 12.7 cm above the plate. The resulting coating was tacky and soluble in 2-butanone. A second 2.5 cm×7.6 cm×1 mm thick glass plate was clamped to the coating and the resulting assembly heated for 10 minutes in the 102° C. vapor of mixed perfluorooctane/perfluoro-2-butyltetrahydrofuran. A strong rigid laminate was produced. Cured coating not sandwiched between the glass could only be slightly scratched after 100 double rubs with a 2-butanone-saturated cotton applicator.

Replacing the 3 minute UV exposure in air with a 1 minute UV exposure immediately upon entering the 102° C. saturated vapor produced a clear, glossy, hard, tack-free coating completely unaffected by the 2-butanone treatment.

EXAMPLE 8

This example illustrates the use of the invention to cure a variety of coating compositions. Six low viscosity, solventless coating compositions were prepared by dissolving 2 parts photoinitiator in a mixture of 60 parts prepolymer ("base resin") and 40 parts low viscosity organic compound ("diluent monomer"). The ingredients were as follows:

Base resin I-Bisphenol A diglycidylether diacrylate ("Epocryl 370", Shell Chemical Co.).

Base resin II-Bisphenol A diglycidylether ("Epon 828", Shell Chemical Co.) reacted with acrylic acid, at an equivalent ratio of 0.5 moles acrylic acid per mole of epoxide groups.

Base resin III-Bisphenol A diglycidylether ("DER 337", Dow Chemical Co.).

Diluent monomer A-Butyl acrylate.

Diluent monomer B-Glycidyl methacrylate.

Diluent monomer C-Butyl glycidyl ether.

Photoinitiator 1-"Irgacure 651".

Photoinitiator 2-Triarylsulfonium hexafluoroantimonate.

The coatings were applied with a #16 wire wound rod onto 5 cm×7.6 cm×1 mm thick glass plates. The coatings were photopolymerized by exposure to UV light from a 275 watt sunlamp placed 12.7 cm above the coatings, with photopolymerization being carried out in room air or in the 102° C. vapor of mixed perfluorooctane/perfluoro-2-butyltetrahydrofuran. The cured coatings were all smooth. The measured cure time for coatings cured in CIPV was taken as the time required for the coating to reach a tack-free state and exhibit resistance to 20 double rubs with a 2-butanone-saturated cotton swab. The cure time for coatings cured in ambient air was taken as the time for the coating to reach a tack-free state only. The ingredients in each coating composition, the polymerization mechanism and the results are set out below in Table VIII.

TABLE VII

| Ingredients | | | Poly- | Cure time (sec.) | |
|---|---|---|---|---|---|
| Base resin | Diluent monomer | Photo-initiator | merization mechanism[a] | UV cure in ambient air | UV cure in 102° C. vapor |
| I | A | 1 | R | 360 | 10 |
| I | A | 2 | R | >>600 | 10 |
| II | A | 2 | CR | 270 | 10 |
| II | B | 2 | CR | >>600 | 45 |
| II | C | 2 | CR | >600 | 15 |
| III | C | 2 | C | 180 | 15 |

[a]R = free-radically polymerizable; C = cationically polymerizable; CR = both cationically and free-radically polymerizable.

The above data illustrates the greatly accelerated curing rate of all of the coatings using UV and condensation heating rather than UV in air.

EXAMPLE 9

This example illustrates the improved weatherability of a coating cured according to the invention. A coating composition was prepared from 100 parts of the hexafunctional acrylic ester described in Example 1 of U.S. Pat. No. 4,249,011 (Wendling), 4 parts "Irgacure 651" photoinitiator, and 233 parts 2-butanone as solvent. This composition was applied to clear polycarbonate plastic sheets with a #14 wire wound rod and allowed to air dry. The coating was cured using a continuous in-line vapor phase soldering unit (Model IL-6, HTC), equipped with a UV source containing a 300 watt/inch 4H mercury lamp (Model F440, Fusion Systems). The UV source was separated from the soldering unit by a quartz plate. A mixture of perfluoro-N,N-dibutyl-N-methylamine and perfluoro-N-butylpiperidine boiling at 130° C. was used for condensation heating. The condensation heating fluid was heated to 130° C. and the UV lamp was switched on. The coated plastic sheets were passed through the curing apparatus at a speed of 1.5 m/min. A comparative sample was cured in the same apparatus under the same conditions except that 40° C. air was used as the atmosphere in the apparatus. The measured thickness of the cured coatings was 8.4 microns.

Cure progress was determined by monitoring disappearance of the 810 $cm^{-1}$ C=C absorbance. The coatings were evaluated for adhesion to the plastic substrate by measuring the percentage of the coating remaining in a razor cut crosshatched area following removal of a piece of "Scotch" Brand 610 transparent tape pressed firmly on the crosshatched area. Abrasion resistance was evaluated before, during and after a 400 hour accelerated weathering cycle, by measuring the pressure required to scratch the coating surface after 10 double rubs with grade 000 steel wool, using the test described in U.S. Pat. No. 4,073,967 (Sandvig). The accelerated weathering cycle was carried out in a QUV Cyclic Ultraviolet Weathering Tester set on Cycle 4-3, using the procedure described in ASTM Standard G53-77. This procedure employs 6.5 hours of UV exposure at 65° C. followed by 1.5 hours water condensation exposure at 50° C. for each cycle. The results are set out below in Table IX.

TABLE IX

| Poly-merization conditions | Weathering cycle, hours | Adhesion, % remaining coating | Abrasion resistance, $kg/cm^2$ |
|---|---|---|---|
| UV cure in | 0 | 100 | 2.46 |
| 130° C. | 200 | 70 | 2.11 |
| CIPV[a] | 400 | 10 | 0.70 |
| UV cure in | 0 | 100 | 1.40 |
| 40° C. | 200 | 10 | 0.36 |
| air[b] | 400 | 0 | 0.36 |

[a]92% Acrylate reaction.
[b]81% Acrylate reaction.

The above results illustrate the higher degree of cure (% acrylate reaction), improved initial abrasion resistance (% remaining coating), and improved abrasion resistance after weathering for a coating composition cured according to the invention.

Various modifications and alterations of this invention will become apparent to those skilled in the art without departing from the scope and spirit of this invention, and it should be understood that this invention is not limited to the illustrative embodiments set forth herein.

I claim:

1. A method for curing a free-radically polymerizable radiation-curable organic coating composition, said composition being insoluble or indispersible in inert perfluorochemical liquid, comprising the steps of (A) coating said composition on a substrate, and then (B) exposing said coating to condensing inert perfluorochemical vapors, said vapors being produced by boiling or heating said inert perfluorochemical liquid, and simultaneously exposing said coating to radiant energy, whereby said coating is cured to a solvent resistant state.

2. A method according to claim 1, wherein said coating composition comprises an acrylate or methacrylate resin.

3. A method according to claim 1, wherein said perfluorochemical boils between about 50° C. and about 150° C.

4. The method of claim 1 wherein said organic coating comprises bireactive monomer, oligomer, or prepolymer.

5. A method according to claim 1 wherein said radiant energy comprises UV radiation.

6. A method for curing a cationically-polymerizable, radiation-curable organic coating composition, said composition being insoluble or indispersible in inert perfluorochemical liquid, comprising the steps of (A) coating said composition on a substrate, and then (B) exposing said coating to condensing inert perfluorochemical vapor said vapor being a least 120° C. and being produced by boiling or heating said inert perfluorochemical liquid, and (C) exposing said coating to radiant energy, whereby said coating is cured to a solvent resistant state.

7. A method according to claim 16, wherein said coating composition comprises an epoxy resin.

* * * * *